United States Patent [19]

Simkovich

[11] Patent Number: 4,711,665

[45] Date of Patent: Dec. 8, 1987

[54] OXIDATION RESISTANT ALLOY

[75] Inventor: George Simkovich, State College, Pa.

[73] Assignee: Pennsylvania Research Corporation, University Park, Pa.

[21] Appl. No.: 759,547

[22] Filed: Jul. 26, 1985

[51] Int. Cl.[4] ..... C22C 38/18

[52] U.S. Cl. ..... 75/244; 501/97; 416/241 R; 428/937

[58] Field of Search ..... 420/614, 442, 443, 436; 75/126 K, 126 Q, 126 G, 126 J, 244, 246, 251; 148/408, 409, 410, 419; 416/241 R, 241 B

[56] References Cited

U.S. PATENT DOCUMENTS

| | | | |
|---|---|---|---|
| 3,409,417 | 11/1968 | Yates | 428/539.5 |
| 3,542,530 | 5/1968 | Talboom, Jr. et al. | 428/667 |
| 3,676,085 | 2/1971 | Evans et al. | 420/437 |
| 3,754,903 | 9/1970 | Goward et al. | 420/443 |
| 3,778,249 | 12/1973 | Benjamin et al. | 75/126 G |
| 3,787,229 | 2/1971 | Rudness | 29/195 |
| 3,918,139 | 7/1974 | Felten | 29/194 |
| 3,928,026 | 5/1974 | Hect et al. | 75/134 F |
| 3,941,903 | 11/1982 | Tucker, Jr. | 427/190 |
| 3,992,161 | 11/1976 | Cairns et al. | 75/126 G |
| 4,018,569 | 2/1976 | Chang | 428/678 |
| 4,043,839 | 5/1976 | Hartline, III et al. | 148/16.6 |
| 4,075,376 | 2/1978 | Jaeger | 427/328 |
| 4,094,673 | 11/1976 | Erickson et al. | 75/126 Q |
| 4,101,715 | 6/1977 | Rairden, III | 428/652 |
| 4,198,442 | 10/1977 | Gupta et al. | 427/34 |
| 4,312,682 | 12/1979 | Herchenroeder | 148/2 |
| 4,334,926 | 3/1980 | Futamura et al. | 75/230 |
| 4,346,137 | 12/1979 | Hect | 428/215 |
| 4,400,209 | 6/1982 | Kudo et al. | 420/443 |
| 4,439,470 | 5/1982 | Slevers | 427/436 |
| 4,546,049 | 10/1985 | Kuze | 428/614 |
| 4,550,063 | 10/1985 | Galasso et al. | 428/614 |

FOREIGN PATENT DOCUMENTS

| | | |
|---|---|---|
| 61611 | 10/1982 | European Pat. Off. . |
| 52-104405 | 9/1977 | Japan . |

*Primary Examiner*—L. Dewayne Rutledge
*Assistant Examiner*—Deborah Yee
*Attorney, Agent, or Firm*—Scully, Scott Murphy & Presser

[57] ABSTRACT

An oxidation resistant alloy comprising about 3 to 14 percent Cr by weight, about 3 to 50 percent by volume $Si_3N_4$, and the balance selected from the group consisting of Fe, Ni, Co and alloys of these metals. Preferably, the Cr content is between 8 to 12 percent by weight, the $Si_3N_4$ content is between about 3 to 22 percent by volume, and the alloy further includes between 1 to 2 percent Si by weight and between about 0.05 and 0.2 percent by weight of a reactive element.

4 Claims, 3 Drawing Figures

PARABOLIC RATE CONSTANT (kp) AT 1000° C and 1 ATMOSPHERE OF OXYGEN FOR VARIOUS ALLOYS

IRON-BASED ALLOYS

| | ALLOY COMPOSITION | kp ($g^2 cm^{-4} sec^{-1}$) |
|---|---|---|
| 1. | Pure Fe | $4.0 \times 10^{-7}$ |
| 2. | Fe-3Cr-1Si | $9.1 \times 10^{-10}$ |
| 2a. | Fe-3Cr-10 vol% $Si_3N_4$ | $3.3 \times 10^{-14}$ |
| 3. | Fe-3Cr-2Si | $1.8 \times 10^{-12}$ |
| 3a. | Fe-3Cr-2Si-10 vol% $Si_3N_4$ | $5.5 \times 10^{-15}$ |
| 4. | Fe-5Cr-2Si | $6.2 \times 10^{-10}$ |
| 4a. | Fe-5Cr-2Si-10vol %$Si_3N_4$ | $7.2 \times 10^{-14}$ |
| 5. | Fe-9Cr-2Si | $5.2 \times 10^{-11}$ |
| 5a. | Fe-9Cr-2Si-10 vol %$Si_3N_4$ | $1.8 \times 10^{-13}$ |
| 6. | Fe-19Cr-10Ni (304L) | $4.3 \times 10^{-12}$ |
| 7. | Fe-17Cr-1Si (434) | $4.5 \times 10^{-12}$ |

NICKEL-BASED ALLOYS

| | ALLOY COMPOSITION | kp ($g^2 cm^{-4} sec^{-1}$) |
|---|---|---|
| 8. | Ni-2.64Cr | $2.8 \times 10^{-9}$ |
| 8a. | Ni-3Cr-5vol %$Si_3N_4$ | $1.3 \times 10^{-10}$ |
| 9. | Ni-5Cr | $2.5 \times 10^{-9}$ |
| 9a. | Ni-5Cr-5vol%$Si_3N_4$ | $1.9 \times 10^{-13}$ |
| 10. | Ni 14.82Cr | $1.30 \times 10^{-11}$ |
| 10a. | Ni-15Cr-5vol%$Si_3N_4$ | $1.45 \times 10^{-13}$ |
| 11. | Ni 9.81Cr | $1.8 \times 10^{-9}$ |
| 11a. | Ni-9Cr-10vol%$Si_3N_4$ | $5.2 \times 10^{-15}$ |
| 12. | Ni-20Cr-0.04$La_2O_3$-0.04$Y_2O_3$ | $3.3 \times 10^{-13}$ |
| 13. | Ni-20Cr | $2.9 \times 10^{-12}$ |

COBALT-BASED ALLOYS

| | ALLOY COMPOSITION | kp ($g^2 cm^{-4} sec^{-1}$) |
|---|---|---|
| 14. | Co-12Cr-10vol%$Si_3N_4$ | $5.5 \times 10^{-13}$ |

FIG. 2

OXIDATION RESISTANT ALLOY

BACKGROUND OF THE INVENTION

This invention generally relates to alloys that are highly resistant to corrosion, and more particularly to MCr alloys, where M is a metal such as Fe, Ni, Co, or alloys of these metals.

Numerous alloys have been specifically developed for their resistance to corrosion. Such alloys are employed, for example, in turbine engines used in high temperature aerospace applications, and in many other highly corrosive environments. Often, articles made from these alloys are covered with a coating to improve the resistance of the article to corrosion. One class of such alloys is referred to as MCr alloys, where M is a metal such as Fe, Co, Ni, and occassionally alloys of these metals. These alloys also are frequently utilized as coating, and commonly they further include Al and small amounts of Y or an equivalent reactive metal.

In most of these alloys, the Cr content is greater than 15 percent by weight, with some of the alloys containing Cr in the range of 25 to 40 percent by weight. Cr is a relatively expensive material, however. Also, more than 90 percent of the Cr used in the United States is imported, and the availability and precise cost of foreign Cr are often very unstable. Because of these disadvantages, and other disadvantages associated with using imported materials, efforts have been made to provide suitable corrosion-resistant alloys that do not include as much Cr.

It is known that the Cr content of these alloys can be reduced without affecting the resistance of the alloy to corrosion by substituting sufficiently high concentrations of Si. However, the presence of these high concentrations of Si increases the brittleness of the alloys considerably, resulting in materials that are unsuitable for many, if not most, of the applications in which the MCr alloys are used.

SUMMARY OF THE INVENTION

A general object of this invention is to reduce the Cr content in MCr alloys while maintaining the alloys' resistance to corrosion without imparting solid-solution brittleness to the alloys.

A more specific object of the present invention is to add $Si_3N_4$ particles to MCr alloys which thereby permits decreasing the Cr content in the alloys while maintaining the alloys' resistance to corrosion.

These and other objects are attained with an oxidation resistant alloy comprising about 3 to 14 percent Cr by weight, about 3 to 50 percent by volume $Si_3N_4$, with the balance of the alloy selected from the group consisting of Fe, Ni, Co, and alloys of these metals. Preferably, the Cr content is about 8 to 12 percent by weight and the $Si_3N_4$ content is about 3 to 22 percent by volume, and the alloy further includes between about 1 and 2 percent Si by weight and about 0.05 to 0.2 percent by weight of a reactive element.

BRIEF DESCRIPTION OF THE DRAWINGS

FIG. 2 is a table giving parabolic rate constants for various alloys.

DETAILED DESCRIPTION OF THE PREFERRED EMBODIMENT

Figure 1:
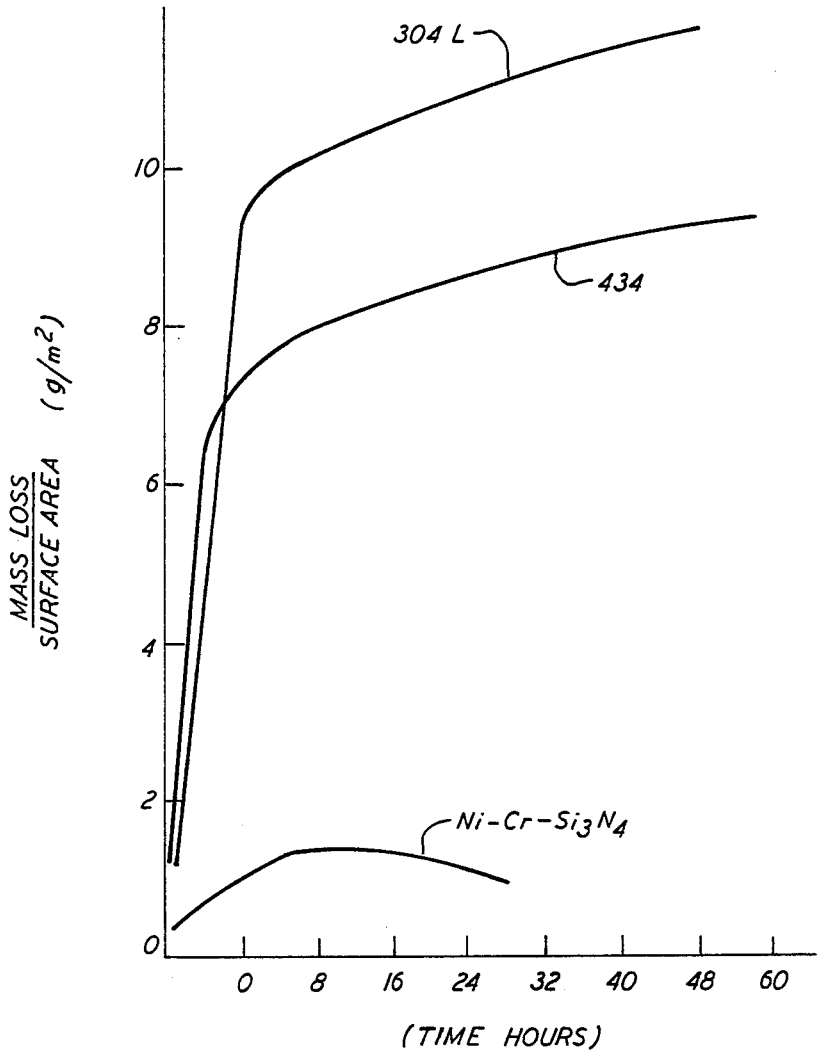
FIG. 1 is a graph showing the corrosion rates of several alloys.

In accordance with the present invention, it has been learned that by utilizing $Si_3N_4$ particles in MCr alloys, the Cr content of the alloys may be reduced while the high temperature oxidation resistance of the alloy may be retained. Specifically, by adding from 3 to 50 percent by volume $Si_3N_4$, the Cr content can be reduced to 3 to 14 percent by weight without affecting the corrosion resistance of the alloy. Preferably, the $Si_3N_4$ content is maintained between 3 to 20 percent by volume and it is believed that best results are obtained when the $Si_3N_4$ content is between 8 and 12 percent by volume. At the same time, it is preferred to keep the Cr level above about 8 percent by weight, with optimum results being obtained when the Cr content is between 10 to 12 percent by weight. The $Si_3N_4$ may increase the brittleness of the alloys; although, first, the increased brittleness is not due to the presence of Si in solution in the alloy, and second, the extent to which the brittleness of the alloy increases is believed to be less than if Si is simply substituted for Cr.

MCr alloys commonly include small amounts of Al, which, in use, reacts with oxygen to form corrosion-inhibiting aluminum oxides. Al may be added to the alloys of this invention without departing from the scope of the invention, although it is preferred to keep Al out of the alloys. MCr alloys often further include a reactive metal such as Y, Sc, Th, La or another rare Earth element. It is believed that these reactive metals help to hold outside oxide layers to the underlying material and, in this way, reduce spalling and the kinetics of corrosion. Preferably, the alloys of this invention are provided with up to 0.2 percent by weight of a reactive metal, and it is believed that it is most advantageous to provide the alloys with between 0.05 and 0.15 percent by weight of a reactive metal. Si may be added to the alloys of the present invention to increase the strength of the alloys and to further improve the corrosion resistance of the alloys. Preferably, the Si content is maintained below 2½ percent by weight, and it is believed that maximum benefits are obtained from the Si when the level thereof is kept between 1 and 2 percent by weight.

The corrosion resistance of an alloy may be measured in several ways. With one method, the alloy is heated in an oxygen-enriched environment, and the mass of the alloy is monitored. The alloy corrodes by reacting with that oxygen to produce oxides on the surface of the alloy, which increase the mass thereof. The extent to which that mass increases is an indication of the corrosion of the alloy, and FIG. 1 is a graph comparing the change in mass per unit surface area over time for three alloys heated to 1000° C. at an oxygen pressure of one atmosphere. The curve labeled 304L shows the oxidation resistance of a typical stainless steel, referred to in the art as 304L, having a nominal composition of 19 percent Cr, 10 percent Ni, and the balance Fe; and the curve labeled 434 shows the oxidation resistance of a second typical stainless steel having a nominal composition of 17 percent Cr, 1 percent Si, and the balance Fe and referred to in the art as 434. The curve labeled $NiCrSi_3N_4$ shows the oxidation resistance of an alloy in accordance with this invention and having the nominal composition 9 percent Cr by weight, 10 percent $Si_3N_4$ by volume, and the balance Ni. As illustrated in FIG. 1, the mass loss of the alloy of this invention is about an order of magnitude less than the mass loss of the two typical stainless steels.

A value that is used to compare the corrosion resistance of different alloys is referred to as the parabolic rate constant. This value is obtained by measuring the mass of an alloy as it corrodes; and, at various points in time, dividing the change in mass of the alloy by the surface area thereof, squaring that quotient, and then plotting this resulting value against time. Typically, this plot is initially curved and then becomes an approximately straight line as time increases, and the slope of this line is the parabolic rate constant for the alloy at the conditions at which the alloy was treated. FIG. 2 shows parabolic rate constants for several alloys heated at 1000° C. at an oxygen pressure equal to one atmosphere. Alloys 1, 2, 3, 4, 5, 6, 7, 8, 9, 10, 11, 12, and 13 listed in FIG. 2 are prior art alloys; while alloys 2a, 3a, 4a, 5a, 8a, 9a, 10a, 11a, and 14 are all in accordance with this invention. Alloys 6 and 7 are the above-discussed typical stainless steel alloys 304L and 434 respectively, and alloys 12 and 13 are typical commercial super alloys. As FIG. 2 demonstrates, adding $Si_3N_4$ to prior art alloys substantially improves the parabolic rate constant of the alloys.

Figure 3:
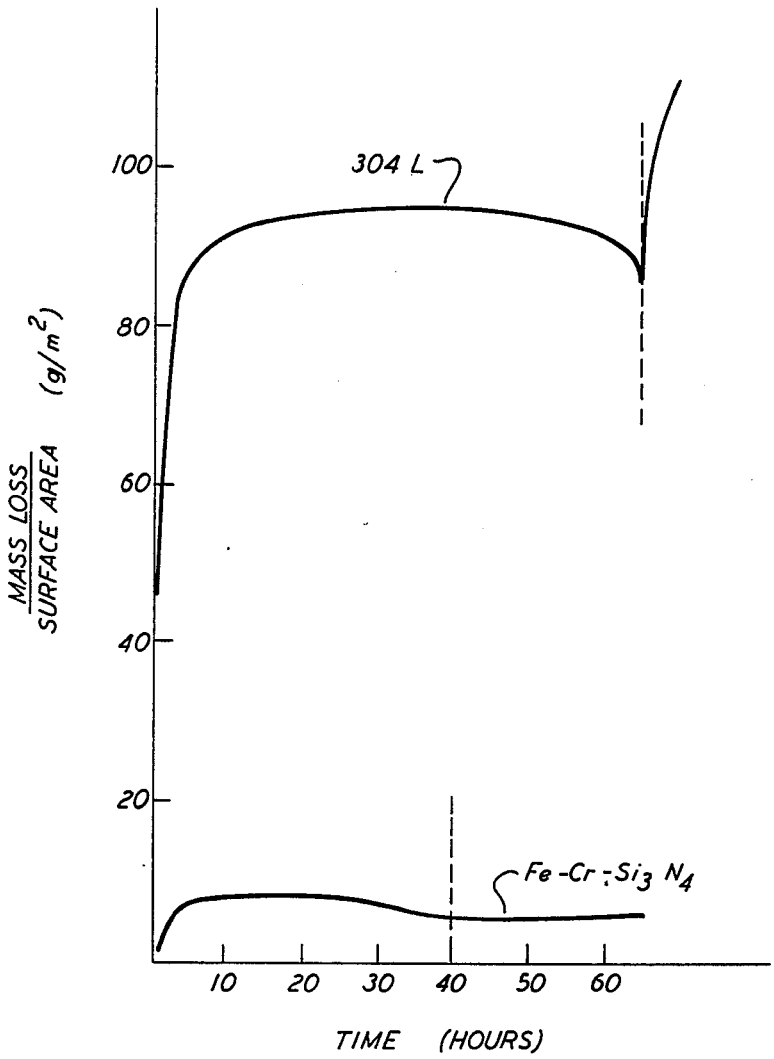
FIG. 3 is another graph showing the spalling rates of two alloys subject to thermal cycling.

An additional, unexpected advantage of the alloys of this invention is that they exhibit minimal, if any, spalling upon thermal cycling. To elaborate, with many alloys, as an alloy corrodes, if the temperature of the alloy is cycled over a comparatively large range, oxide scales come off the alloy—an affect referred to as spalling. Spalling, like corrosion resistance, may be measured by monitoring the changes in the mass of an alloy per unit of surface area over time, and FIG. 3 shows the spalling of two alloys: the above-mentioned alloy 304L; and an FeCr alloy of this invention having the nominal composition 3 percent Cr by weight, 2 percent Si by weight, 10 percent $Si_3N_4$ by volume, and the balance Fe. These two alloys were heated at 1100° C. for approximately 60 hours and 40 hours, respectively, and then the temperature of each alloy was cycled between approximately 23° and 1100° C. As FIG. 3 clearly demonstrates, the prior art 304L alloy lost a considerable amount of mass—the result of spalling—after thermal cycling began, while the alloy of this invention had no appreciable mass loss.

Any suitable method may be used to produce the alloy of this invention. With one acceptable method, powders of the alloy components are mixed thoroughly, cold-pressed at about 22° C. to the desired size and shape, and then sintered at about 1200° to 1250° C. in a clean, inert atmosphere or in a vacuum. The novel alloys of the present invention may be used to form articles such as machine parts, or the alloys may be used as a coating for an article to increase the high temperature corrosion resistance thereof.

When making an alloy in accordance with this invention, it is desirable to obtain a uniform dispersion of fine $Si_3N_4$ particles throughout the alloy, although it is believed that the specific size of the $Si_3N_4$ particles is not critical to the corrosion resistance of the alloys. It appears that the $Si_3N_4$ does not enter into solution in the alloy to any major extent, and that this is a primary reason why the $Si_3N_4$ does not embrittle the alloy. At the same time, the $Si_3N_4$ reduces the kinetics of corrosion, thereby maintaining the alloy's resistance to corrosion despite the reduced amount of Cr. It appears further that the addition of the $Si_3N_4$ does not have any appreciable affect on the crystal structure of the alloy.

While it is apparent that the invention herein disclosed is well-calculated to fulfill the objects previously stated, it will be appreciated that numerous modifications and embodiments may be devised by those skilled in the art, and it is intended that the appended claims cover all such modifications and embodiments as fall within the true spirit and scope of the present invention. In particular, those skilled in the art will recognize that certain other elements are compatible with the basic chemistry of the present alloys and may be added to those alloys as required or desired in certain applications for modification of the mechanical or corrosion characteristics of the alloys. For instance, tungsten and molybdenum may be used to give the alloys high temperature strength, although they tend to decrease the alloys' resistance to corrosion.

Similarly, while the advantages of the alloys of this invention are especially well-suited for use in high temperature environments, they may be used in other applications without departing from the scope of the invention; and when it is intended to use the alloys in other applications, it may be desirable to modify or treat the alloys to make them particularly well-adapted for those uses. For instance, when the alloys of this invention are intended for use at room temperature, the corrosion resistance of the alloys can be improved by a moderate to high temperature preoxidation process.

What is claimed is:

1. An oxidation resistant alloy consisting essentially of:

about 8 to 12 percent Cr by weight;

about 3 to 20 percent $Si_3N_4$ by volume;

about 1 to 2 percent Si by weight; up to about 0.2 percent by weight of a reactive element selected from the group consisting of Y, Sc, Th, La, and other rare Earth elements; and the balance selected from the group consisting of Fe, Ni, Co, a Fe-based alloy, a Ni-based alloy and a Co-based alloy.

2. An alloy according to claim 1 wherein the $Si_3N_4$ content is about 8 to 12 percent by volume.

3. An alloy according to claim 1 wherein:

the Cr content is between 10 to 12 percent by weight; and the $Si_3N_4$ content is between 8 to 12 percent by volume.

4. An oxidation resistant alloy according to claim 1, wherein the $Si_3N_4$ consists of powder particles of $Si_3N_4$ dispersed throughout the alloy.

* * * * *